US011469557B2

(12) United States Patent
Morello et al.

(10) Patent No.: US 11,469,557 B2
(45) Date of Patent: Oct. 11, 2022

(54) COAXIAL ELECTRICAL CONNECTOR

(71) Applicant: Aptiv Technologies Limited, St. Michael (BB)

(72) Inventors: John R. Morello, Warren, OH (US); James M. Rainey, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/940,619

(22) Filed: Jul. 28, 2020

(65) Prior Publication Data

US 2022/0037841 A1 Feb. 3, 2022

(51) Int. Cl.

| | |
|---|---|
| ***H01R 24/56*** | (2011.01) |
| ***H01R 43/28*** | (2006.01) |
| ***H01R 103/00*** | (2006.01) |

(52) U.S. Cl.

CPC ..... *H01R 24/56* (2013.01); *H01R 43/28* (2013.01); *H01R 2103/00* (2013.01)

(58) Field of Classification Search

CPC ... H01R 4/01; H01R 4/22; H01R 4/26; H01R 4/60; H01R 13/10; H01R 13/11; H01R 13/111; H01R 13/193; H01R 13/62; H01R 4/185; H01R 4/188; H01R 11/12; H01R 2103/00; H01R 43/048; H01R 4/183; H01R 9/0518; H01R 4/20; H01R 4/203; H01R 4/62; H01R 13/6581; H01R 24/40; H01R 43/0585; H01R 43/16; H01R 9/05

See application file for complete search history.

(56) References Cited

U.S. PATENT DOCUMENTS

| | | | | |
|---|---|---|---|---|
| 6,372,991 | B1 | 4/2002 | Myers | |
| 6,517,379 | B2 * | 2/2003 | Leve | H01R 9/0518 439/578 |
| 7,056,148 | B2 | 6/2006 | Staniszewski et al. | |
| 7,195,505 | B1 * | 3/2007 | Becker | H01R 13/5219 439/271 |
| 8,167,636 | B1 * | 5/2012 | Montena | H01R 9/0527 439/322 |
| 8,485,853 | B2 | 7/2013 | Seifert et al. | |
| 9,590,340 | B2 * | 3/2017 | Blumenschein | H01R 13/05 |

(Continued)

FOREIGN PATENT DOCUMENTS

| | | |
|---|---|---|
| EP | 0052980 A2 | 6/1982 |
| FR | 2806216 B1 | 8/2003 |
| JP | 5375574 B2 | 12/2013 |

OTHER PUBLICATIONS

Extended European Search Report for EP Application No. 21186700.7, dated Dec. 20, 2022, 9 pages.

*Primary Examiner* — Renee S Luebke
*Assistant Examiner* — Matthew T Dzierzynski
(74) *Attorney, Agent, or Firm* — Billion & Armitage

(57) ABSTRACT

An electrical connector includes a terminal having a first surface defining a plurality of ridges protruding from the first surface. A first ridge in the plurality of ridges has a different height above the first surface than a second ridge in the plurality of ridges. The plurality of ridges is configured to provide a plurality of electrical contact points between the terminal and a corresponding mating terminal. A method of manufacturing the electrical connector includes the steps of providing a terminal preform formed of sheet metal having the first surface and forming the plurality of ridges which protrude from the first surface.

15 Claims, 9 Drawing Sheets

(56) References Cited

U.S. PATENT DOCUMENTS

| | | | | |
|---|---|---|---|---|
| 9,608,427 | B2 * | 3/2017 | Fulponi | H01R 4/20 |
| 9,667,000 | B1 * | 5/2017 | Morello | H01R 9/0518 |
| 9,673,578 | B1 * | 6/2017 | Lane | H01R 43/048 |
| 9,748,683 | B2 * | 8/2017 | Tsuru | C25D 5/10 |
| 9,970,121 | B2 * | 5/2018 | Ochi | C25D 9/02 |
| 10,177,517 | B1 * | 1/2019 | Lewis | B21D 39/048 |
| 10,224,647 | B2 * | 3/2019 | Hamada | H01R 4/185 |
| 10,424,849 | B2 * | 9/2019 | Staab | H01R 4/183 |
| 10,516,238 | B2 * | 12/2019 | Lee | H01R 13/111 |
| 10,532,628 | B2 | 1/2020 | Wang et al. | |
| 10,741,975 | B2 * | 8/2020 | Jones | H01R 4/185 |
| 2011/0097928 | A1 | 4/2011 | Burris et al. | |
| 2016/0344127 | A1 | 11/2016 | Drew et al. | |
| 2020/0119495 | A1 * | 4/2020 | Bredbeck | H01R 13/6582 |

* cited by examiner

COAXIAL ELECTRICAL CONNECTOR

TECHNICAL FIELD OF THE INVENTION

The invention generally relates to electrical connectors, particularly to an electrical connector suited for use with coaxial cables.

BACKGROUND OF THE INVENTION

Coaxial cable connector assemblies have been used for numerous automotive applications, such as navigation systems, infotainment systems, air bag systems, and other data transmission systems. Coaxial cables typically consist of an outer shield conductor, an inner center conductor, a dielectric, and an insulation jacket. The outer conductor and the inner conductor of the coaxial cable often electrically interface with a mating coaxial cable through a coaxial connector.

Coaxial connectors are often used to connect coaxial cables while providing a certain degree of radio frequency (RF) shielding. The use of coaxial connectors for coaxial cable has greatly increased in automotive applications as devices requiring high speed data communication continue to proliferate.

The use of coaxial connectors for automotive usage has become so common that standards for signal loss and contact resistance have been devised. Some coaxial connectors that meet these specifications use high cost cold drawn tubular shield terminals. Lower cost stamped male shield terminals and female shield terminals are also used; however, these shield terminals have generally provided less effective shielding due to the limited contact points between the shield terminals provided by cantilevered contact springs, contact bumps on the shield terminals, or a separate contact spring inserted between the shield terminals.

Coaxial connectors also need to be properly seated to provide adequate shielding i.e., improper seating or air gaps between shield terminals can cause significant RF leakage. Thus, these coaxial connectors require strict manufacturing tolerances to assure proper seating which drives costs up of each coaxial connector. A modern automobile may have over forty of such coaxial connectors.

Therefore, a low-cost coaxial connector having stamped terminal connectors which meets all performance specifications and has improved shielding performance remains desired.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, an electrical connector is provided. The electrical connector includes a terminal having a first surface defining a plurality of ridges protruding from the first surface. A first ridge in the plurality of ridges has a different height above the first surface than a second ridge in the plurality of ridges. The plurality of ridges is configured to provide a plurality of electrical contact points between the terminal and a corresponding mating terminal.

In an example embodiment having one or more features of the electrical connector of the previous paragraph, there is an air gap of less than 0.1 mm between the terminal and the corresponding mating terminal when the terminal is received within the corresponding mating terminal.

In an example embodiment having one or more features of the electrical connector of the previous paragraph, the first surface defines a plurality of indentations recessed below the first surface.

In an example embodiment having one or more features of the electrical connector of the previous paragraph, the plurality of ridges is arranged on perimeters of the plurality of indentations.

In an example embodiment having one or more features of the electrical connector of the previous paragraph, the plurality of ridges is formed by material displaced from the plurality of indentations.

In an example embodiment having one or more features of the electrical connector of the previous paragraph, the first surface is curved.

In an example embodiment having one or more features of the electrical connector of the previous paragraph, the first surface has a generally cylindrical shape.

In an example embodiment having one or more features of the electrical connector of the previous paragraph, the first surface does not define an aperture extending therethrough.

In an example embodiment having one or more features of the electrical connector of the previous paragraph, the first surface is an outer surface.

In an example embodiment having one or more features of the electrical connector of the previous paragraph, the terminal is an inner shield terminal. The first surface defines an outer surface of the inner shield terminal. The corresponding mating terminal is an outer shield terminal having an inner surface and configured to receive the inner shield terminal within.

In an example embodiment having one or more features of the electrical connector of the previous paragraph, at least a portion of the plurality of ridges are in an interface fit with the inner surface when the inner shield terminal is disposed within the outer shield terminal.

In an example embodiment having one or more features of the electrical connector of any one of the previous paragraphs, the first surface defines a slit extending longitudinally along a length of the first surface and wherein the first surface is configured to exert a spring force against the inner surface of the outer shield terminal.

According to another embodiment of the invention, method of manufacturing an electrical connector is provided. The method includes the step of providing a terminal preform formed of sheet metal. The terminal preform has a first surface. The method also includes the step of forming a plurality of ridges in the first surface which protrude from the first surface. A first ridge in the plurality of ridges has a different height above the first surface than a second ridge in the plurality of ridges.

In an example embodiment having one or more features of the method of the previous paragraph, the plurality of ridges is formed by a knurling process.

In an example embodiment having one or more features of the method of the previous paragraph, the method further includes the step of forming a plurality of indentations in the first surface that are recessed below the first surface.

In an example embodiment having one or more features of the method of the previous paragraph, the plurality of ridges and the plurality of indentations are simultaneously formed by the knurling process.

In an example embodiment having one or more features of the method of the previous paragraph, the method further includes the step of arranging the plurality of ridges between the first surface and the plurality of indentations.

In an example embodiment having one or more features of the method of the previous paragraph, the method further includes the step of arranging the plurality of ridges on perimeters of the plurality of indentations.

In an example embodiment having one or more features of the method of the previous paragraph, the plurality of ridges is formed by material of the terminal preform displaced from the plurality of indentations by the knurling process.

In an example embodiment having one or more features of the method of the previous paragraph, the method further includes the step of bending the terminal preform such that the first surface has a generally cylindrical shape.

In an example embodiment having one or more features of the method of the previous paragraph, the method further includes the step of bending the terminal preform such that edges of the first surface define a slit extending longitudinally along a length of the first surface.

According to yet another embodiment of the invention, an electrical connector is provided. The electrical connector includes a terminal having means for providing a plurality of contact points between the terminal and a corresponding mating terminal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
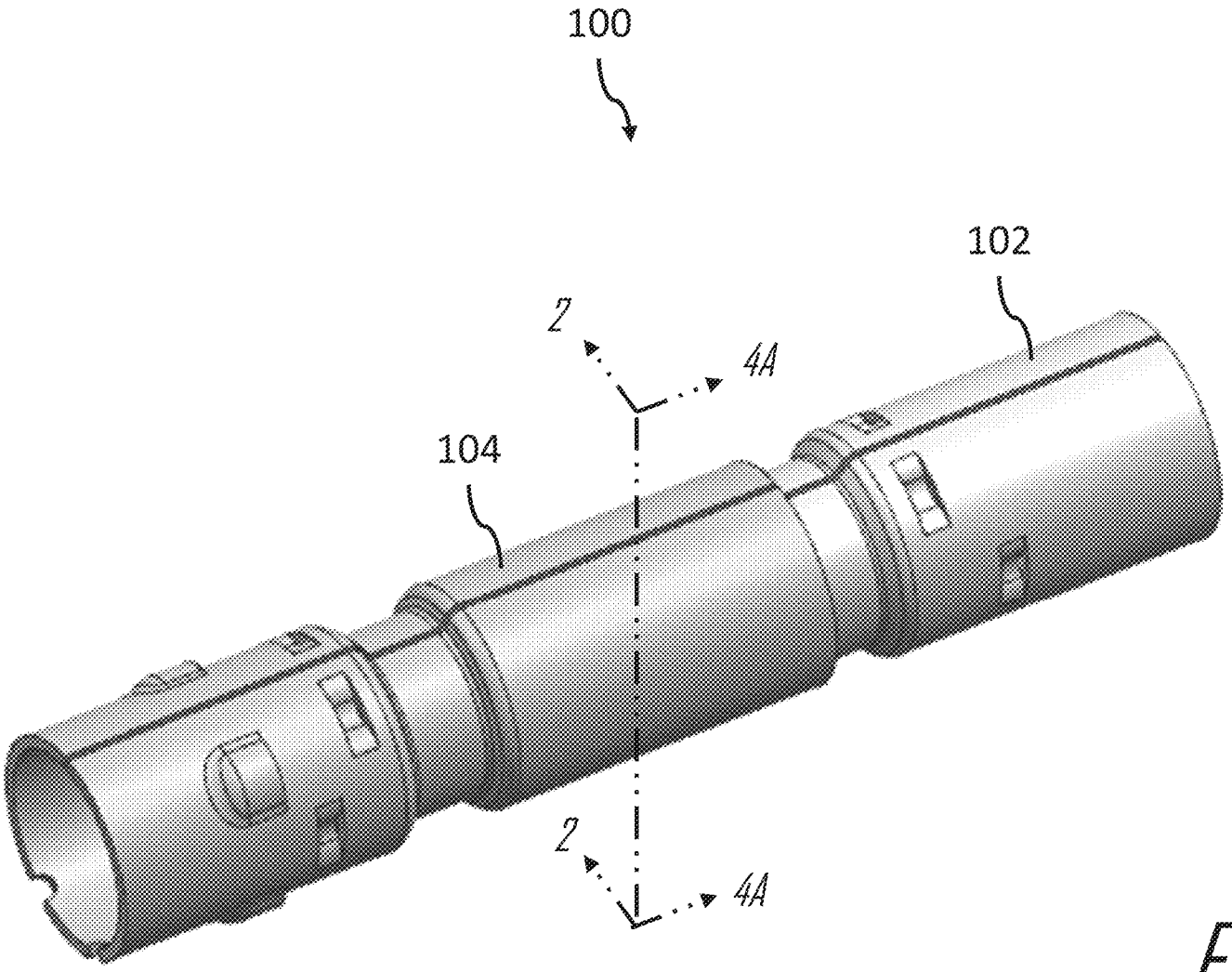
FIG. 1 a perspective view of an electrical connector assembly in a connected configuration in accordance with a first embodiment of the invention.
Figure 2:
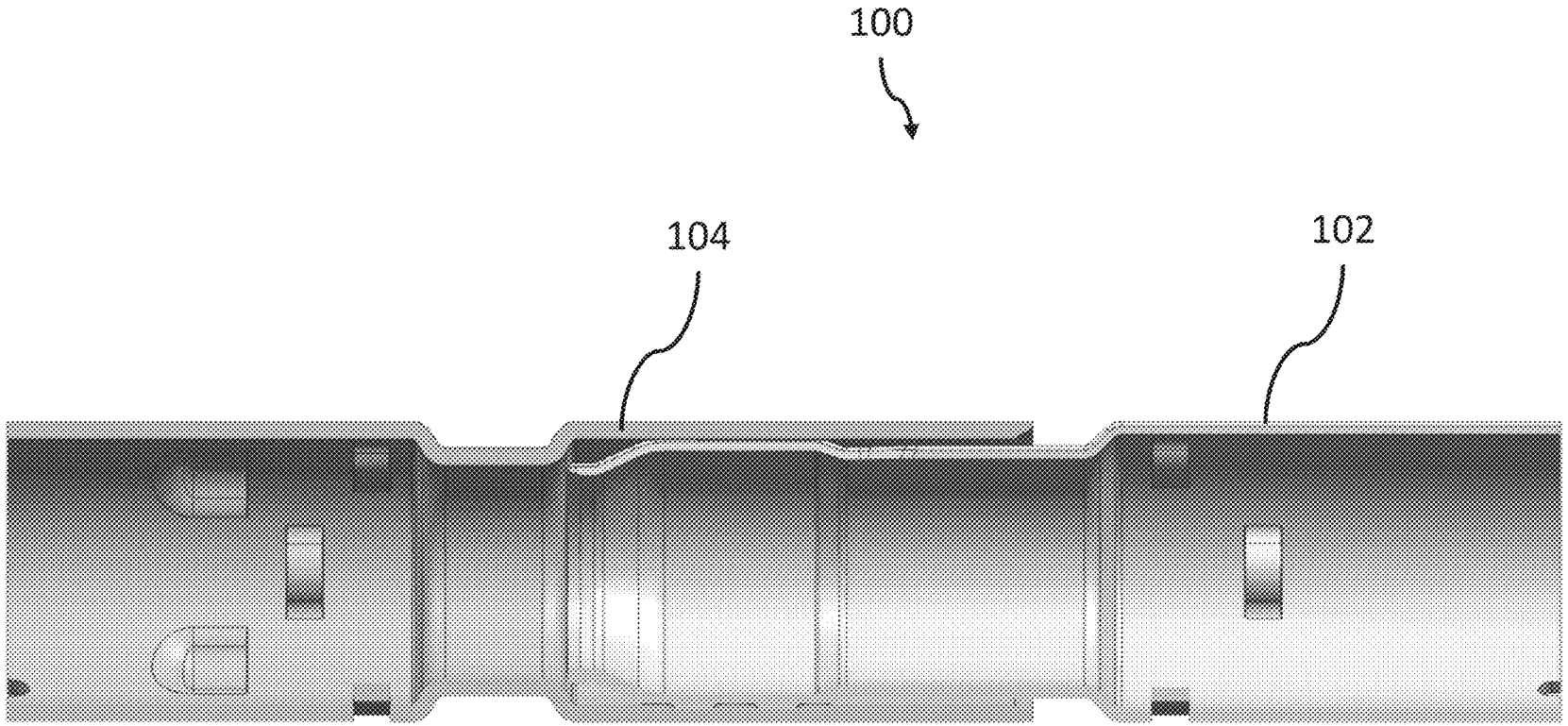
FIG. 2 is a cross-section view of the electrical connector assembly of FIG. 1 in the connected configuration along section line 4-4 in accordance with the first embodiment of the invention.

FIGS. 1 and 2 illustrate an example of a coaxial connector assembly, hereinafter referred to as the assembly 100, configured to interconnect two coaxial cables. The assembly 100 includes a male electromagnetic shield terminal, hereinafter referred to as the terminal 102, that is configured to be attached to the outer shield conductor of a first coaxial cable (not shown) and female electromagnetic shield terminal, hereinafter referred to as the mating terminal 104, that is configured to be attached to the outer shield conductor of a second coaxial cable (not shown) and to receive the terminal 102. The terminal 102 and the mating terminal 104 are configured to surround inner terminals (not shown) attached to inner conductors of the first and second coaxial cables and provide shielding continuity between the first and second coaxial cables.

Figure 3:
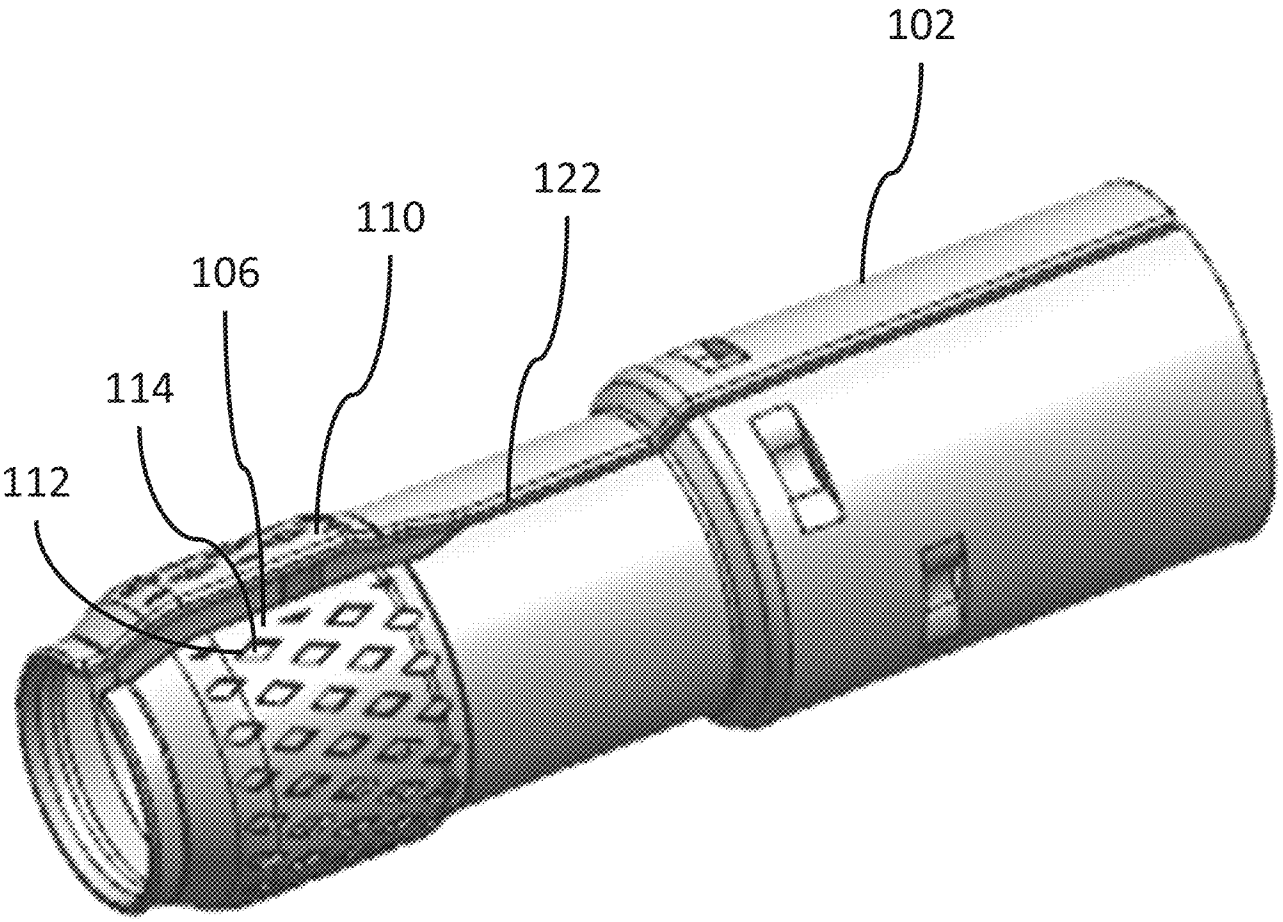
FIG. 3 a perspective view of an electrical connector of the electrical connector assembly of FIG. 1 in accordance with the first embodiment of the invention.

As shown in FIG. 3, the terminal 102 has a generally cylindrical shape that is formed by bending or rolling a terminal preform 106 made of sheet metal. A first surface, hereafter referred to as the outer surface 108 of a contact portion 110 of the terminal 102 defines a plurality of ridges 112 and indentations 114 in the outer surface 108 that are formed by a knurling process performed on the terminal preform 106 prior to bending the terminal preform 106 into the cylindrical shape. As shown in FIGS. 6A and 6B, the ridges 112 are arranged on the perimeter 116 of the indentations 114. The ridges 112 are configured to provide a plurality of electrical contact points between the terminal 102 and the mating terminal 104. In the illustrated example, the indentations 114 and ridges 112 have a rhombic shape, i.e., are in the shape of a rhombus.

The ridges 112 protrude above the outer surface 108 and the indentations 114, are recessed below the outer surface 108. Without subscribing to any particular theory of operation, the ridges 112 are formed by sheet meal material that is displaced as the indentations 114 are formed in the terminal 102 preform by the knurling process. Due to the rhombic shape of the indentations 114, the height of the ridge 112 above the outer surface 108 vary around the perimeter 116 of the indentation 114 due to more material being displaced near the obtuse angled portion 118 of the indentation 114 than at the acute angled portion 120 of the indentation 114. The height of the ridges 112 above the outer surface 108 may also vary due to tolerance variations in the knurling process.

When the terminal 102 is received within the mating terminal 104 at least a portion of the ridges 112 on the outer surface 108 of the terminal 102 are in an interface fit with the inner surface 120 of the mating terminal 104. As shown in FIG. 4B, the highest ridges 112A of the of the plurality of ridges 112 are in mechanical and electrical contact with the inner surface 120 of the mating terminal 104, thereby providing a plurality of electrical connections between the terminal 102 and the mating terminal 104 which lowers the connection resistance and improves shielding efficiency. The ridges 112 protrude from the outer surface 108 at a height that is typically between 0.03 and 0.07 mm. The air gap between the terminal 102 and the mating terminal 104 is reduced to less than 0.1 mm, preferably less than 0.08 mm, more preferably less than 0.05 mm and even more preferably 0.03 mm, further improving shieling efficiency. As shown in FIG. 4B, the ridges 112A, 112B having different height also improve resistance of the assembly 100 to fretting corrosion since higher ridges 112A that may be degraded by fretting are replaced in contact of ridges 112B that had an originally lower height than the initial ridges 112A in contact. The indentation 114 may also serve as a repository for corrosion debris so that it does not interfere in the connector between the terminal 102 and the mating terminal 104.

The terminal 102 defines a slit 122 in the outer surface 108 extending longitudinally along a length of the outer surface 108. The terminal 102 is configured such that the slit 122 is narrowed as the terminal 102 is inserted within the mating terminal 104 such that the outer surface 108 of the terminal 102 exerts a normal spring force against the inner surface 120 of the mating terminal 104, thereby providing a lower resistance and more reliable connection between the terminal 102 and the mating terminal 104 which improves shielding effectiveness. When the terminal 102 is inserted within the mating terminal 104, the width of the slit is reduced to less than 0.1 mm, preferably less than 0.08 mm, and more preferably less than 0.05 mm. The slit 122 is the only opening, hole, gap, breach, or aperture in the outer surface 108 of the terminal 102.

Figure 4A:
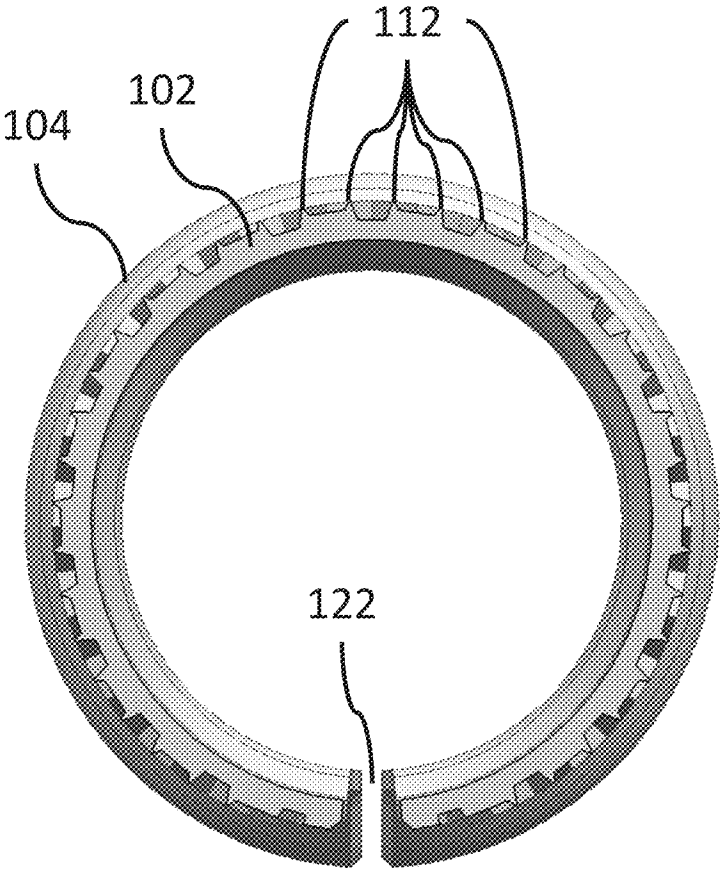
FIG. 4A is a cross-section view of the electrical connector and the corresponding mating electrical connector of FIG. 1 in the connected configuration along section line 4A-4A in accordance with the first embodiment of the invention.
Figure 4B:
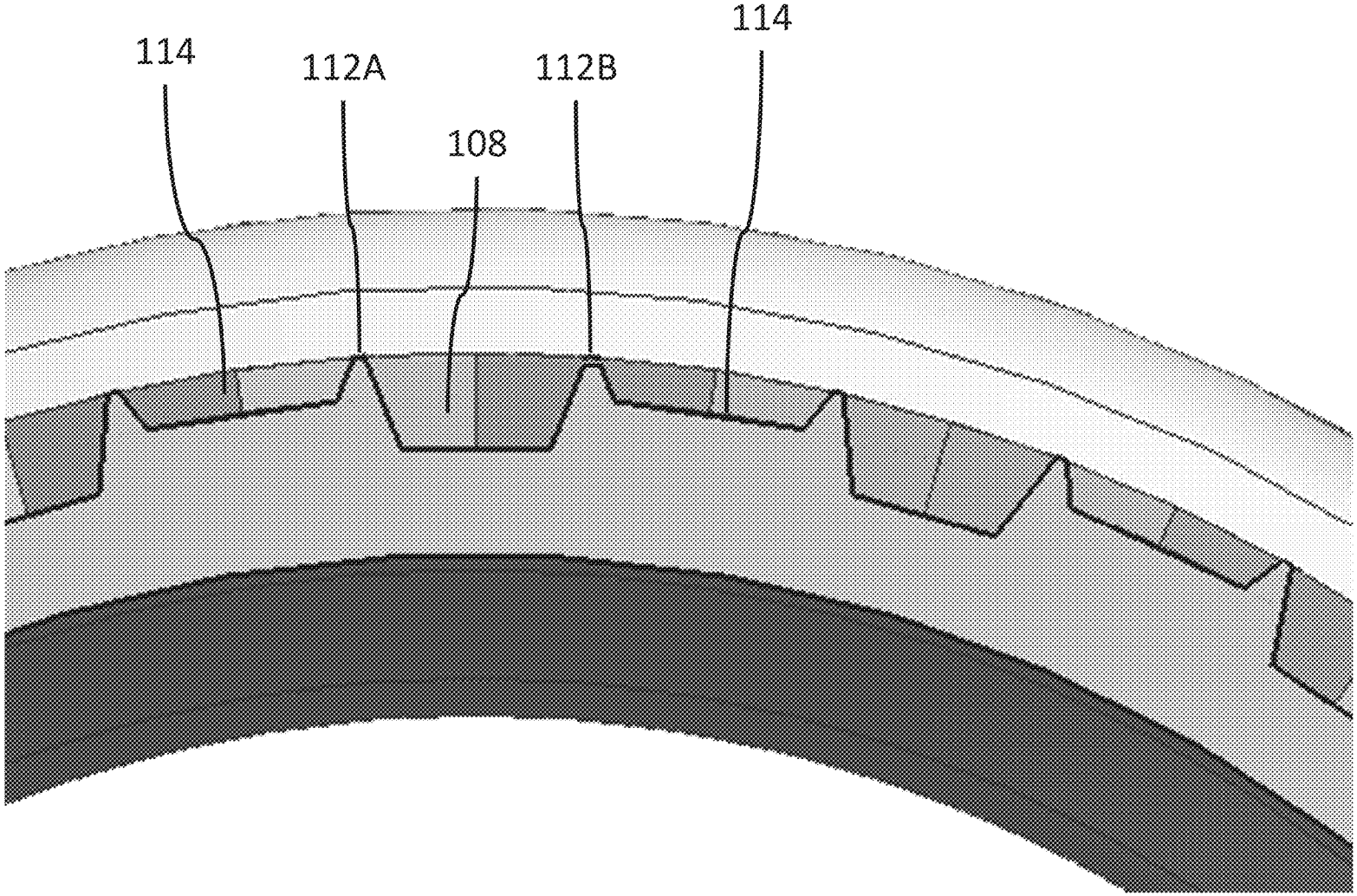
FIG. 4B is an enlarged portion of the cross-section view of FIG. 4A in accordance with the first embodiment of the invention.

While the illustrated example connector assembly 100 of FIGS. 3 through 4B are arranged generally parallel or in line with the cables, alternative embodiments of the connector may be envisioned in which one or both terminals are generally arranged in at right angle to the cables. In yet other alternative embodiments of the connector assembly 100 the connector assembly 100 may be configured to be interconnected to conductive traces on a printed circuit board.

While the illustrated example of FIGS. 3 through 4B has indentions and ridges 112 that define a rhombic shape, alternative embodiments may have other shaped such as square, rectangular, triangular, round, oval, etc.

Figure 5:
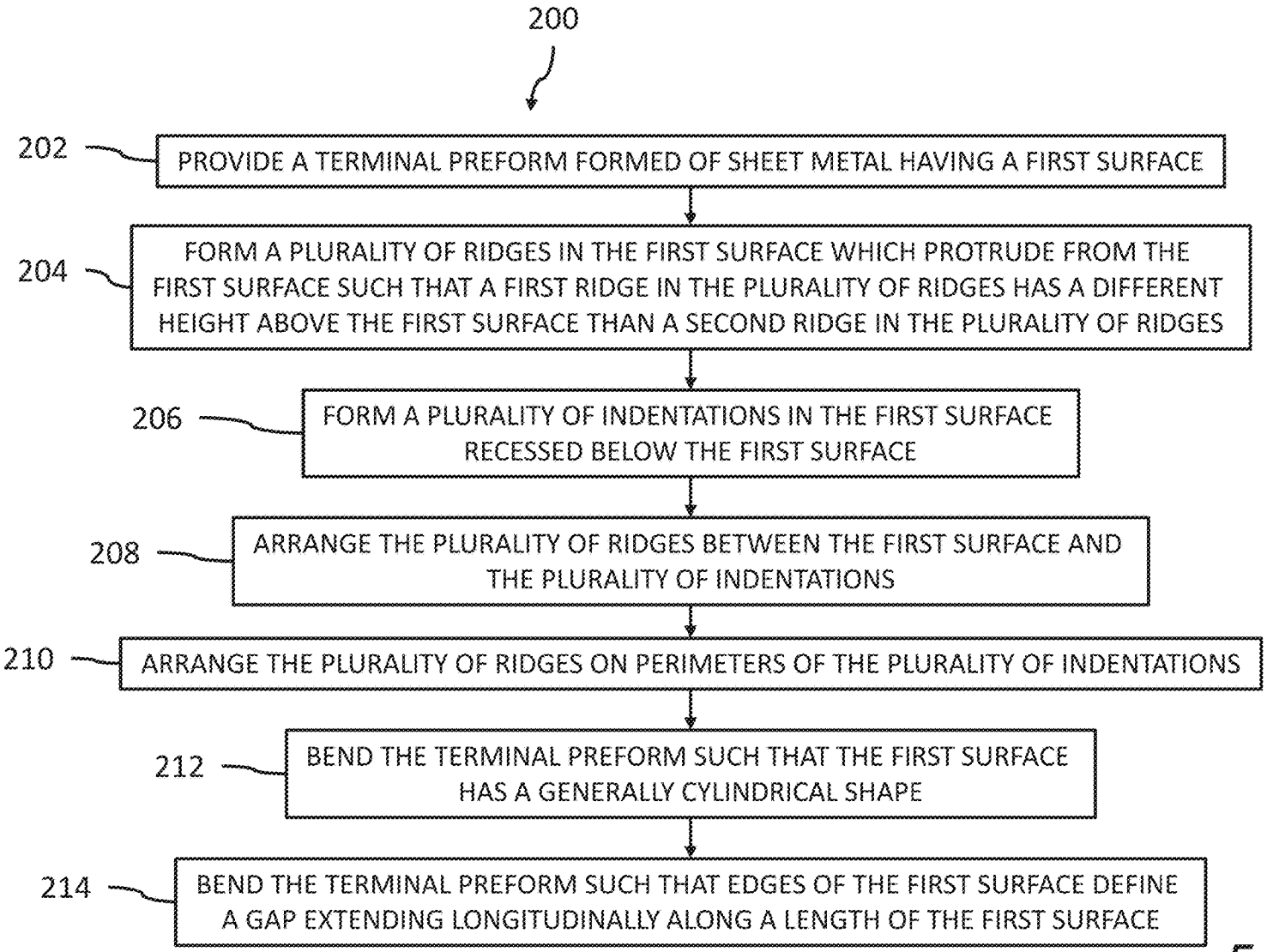
FIG. 5 is a flow chart of a method of manufacturing an electrical connector of in accordance with a second embodiment of the invention.
Figure 6:
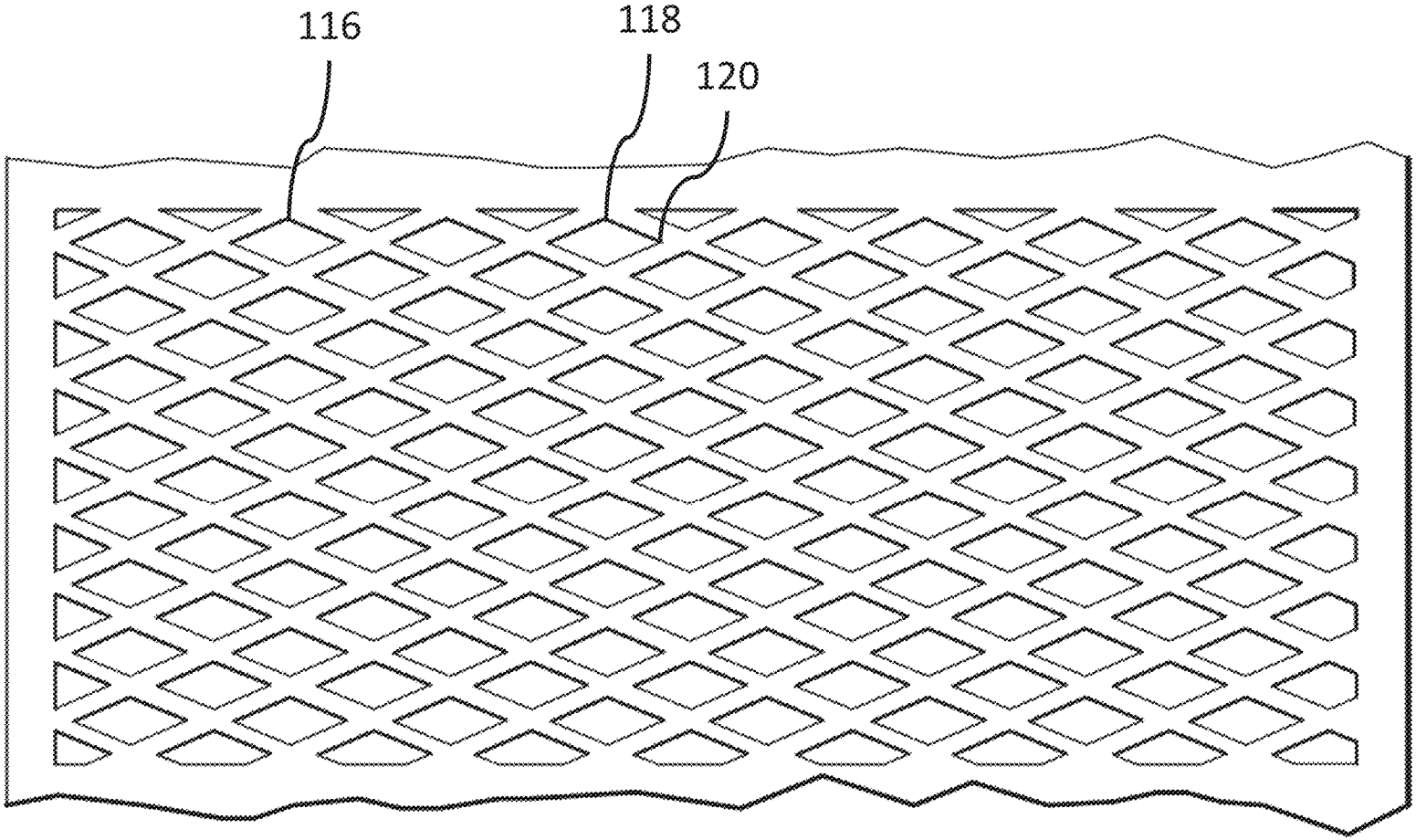
FIG. 6 is a broken out top view of a terminal preform in accordance with the second embodiment of the invention.
Figure 7:
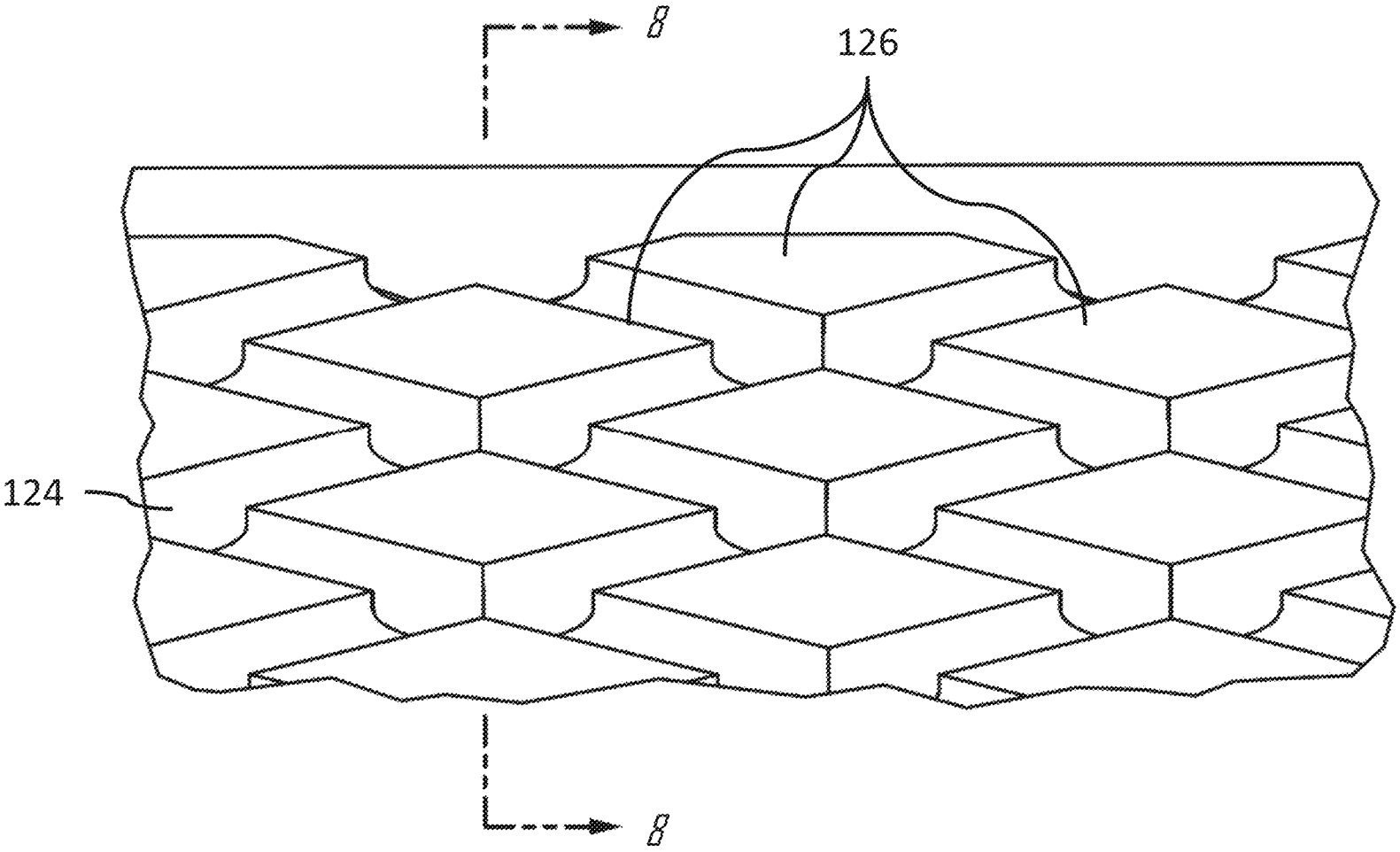
FIG. 7 is a perspective view of a die in accordance with the second embodiment of the invention.
Figure 8:
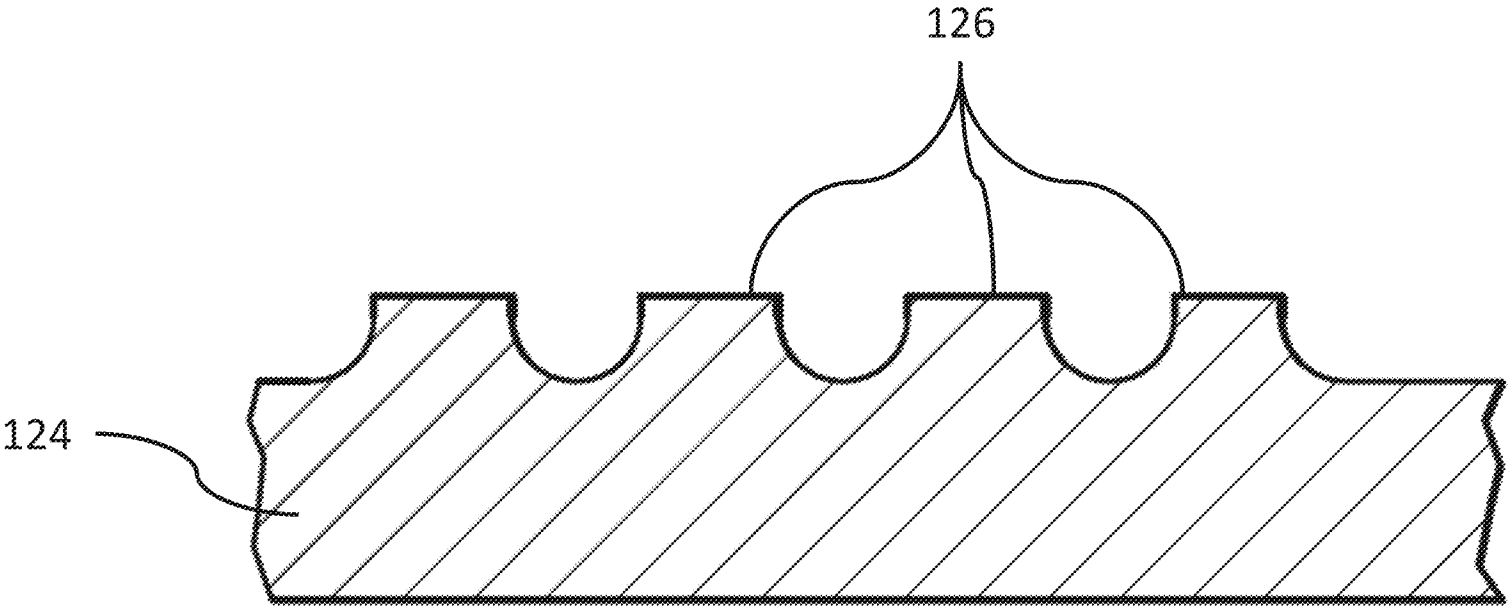
FIG. 8 is a cross-section view of the die of FIG. 7 along the section line 8-8 in accordance with the second embodiment of the invention.

A method 200 of manufacturing an electrical connector assembly 100, such as the one described above is illustrated in FIG. 5 and includes the following steps:

STEP 202, PROVIDE A TERMINAL PREFORM FORMED OF SHEET METAL HAVING A FIRST SURFACE, includes providing a terminal preform 106 formed of sheet metal having a first surface 108 as shown in FIG. 6;

STEP 204, FORM A PLURALITY OF RIDGES IN THE FIRST SURFACE WHICH PROTRUDE FROM THE FIRST SURFACE SUCH THAT A FIRST RIDGE IN THE PLURALITY OF RIDGES HAS A DIFFERENT HEIGHT ABOVE THE FIRST SURFACE THAN A SECOND RIDGE IN THE PLURALITY OF RIDGES, includes forming a plurality of ridges 112 in the first surface 108 which protrude from the first surface 108 using a knurling die 124 having a plurality of protrusions 126 that are pressed into the terminal preform 106 to form the plurality of ridges 112, shown in FIGS. 9 and 10. The plurality of ridges 112 are formed such that a first ridge 112A in the plurality of ridges 112 has a different height above the first surface 108 than a second ridge 112B in the plurality of ridges 112;

STEP 206, FORM A PLURALITY OF INDENTATIONS IN THE FIRST SURFACE THAT ARE RECESSED BELOW THE FIRST SURFACE, includes forming a plurality of indentations 114 in the first surface 108 that are recessed below the first surface 108 by the plurality of protrusions 126 of the knurling die 124 that are pressed into the terminal preform 106 to form the plurality of indentations 114;

STEP 208, ARRANGE THE PLURALITY OF RIDGES BETWEEN THE FIRST SURFACE AND THE PLURALITY OF INDENTATIONS, includes arranging the plurality of ridges 112 so that they are located between the first surface 108 and the plurality of indentations 114;

STEP 210, ARRANGE THE PLURALITY OF RIDGES ON PERIMETERS OF THE PLURALITY OF INDENTATIONS, includes arranging the plurality of ridges 112 so that they are located on the perimeters of the plurality of indentations 114;

STEP 212, BEND THE TERMINAL PREFORM SUCH THAT THE FIRST SURFACE HAS A GENERALLY CYLINDRICAL SHAPE, includes bending or rolling the terminal preform 106 such that the first surface 108 has a generally cylindrical shape; and STEP 214, BEND THE TERMINAL PREFORM SUCH THAT EDGES OF THE FIRST SURFACE DEFINE A SLIT EXTENDING LONGITUDINALLY ALONG A LENGTH OF THE FIRST SURFACE, includes bending the terminal preform 106 such that edges of the first surface 108 define a slit 122 that extends longitudinally along a length of the first surface 108.

Accordingly, an electrical connector assembly 100 and a method 200 of manufacturing an electrical connector is provided. The assembly 100 and the method 200 provide the benefits over the prior art connector assemblies of improved shielding efficiency due to a lower connection resistance and reduced air gap between the terminal 102 and the mating terminal 104. The assembly 100 and the method 200 also provide improve resistance of the assembly 100 to fretting corrosion.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising:

a terminal having a first surface defining a plurality of ridges protruding from the first surface, wherein a first ridge in the plurality of ridges has a first height above the first surface and is configured to provide a first electrical contact point between the terminal and a corresponding mating terminal, wherein a second ridge in the plurality of ridges has a second height above the first surface that is lower than the first height, wherein the second ridge in the plurality of ridges is configured to provide a second electrical contact point between the terminal and the corresponding mating terminal after the first electrical contact point is degraded by fretting, wherein the first surface defines a plurality of indentations recessed below the first surface, wherein the plurality of ridges is arranged on perimeters of the plurality of indentations, and wherein the plurality of ridges is formed by material displaced from the plurality of indentations.

2. The electrical connector assembly according to claim 1, wherein there is an air gap of less than 0.1 mm between the terminal and the corresponding mating terminal when the terminal is received within the corresponding mating terminal.

3. The electrical connector assembly according to claim 1, wherein the first surface is curved.

4. The electrical connector assembly according to claim 1, wherein the first surface does not define an aperture extending therethrough.

5. The electrical connector assembly according to claim 4, wherein the first surface is an outer surface.

6. The electrical connector assembly according to claim 5, wherein the terminal is an inner shield terminal, wherein the first surface defines an outer surface of the inner shield terminal, and wherein the corresponding mating terminal is an outer shield terminal having an inner surface and configured to receive the inner shield terminal within.

7. The electrical connector assembly according to claim 6, wherein at least a portion of the plurality of ridges are in an interface fit with the inner surface when the inner shield terminal is disposed within the outer shield terminal.

8. The electrical connector assembly according to claim 1, wherein the second ridge in the plurality of ridges is configured to provide the second electrical contact point between the terminal and the corresponding mating terminal only after the first ridge in the plurality of ridges providing the first electrical contact point is degraded by fretting.

9. An electrical connector assembly, comprising:

a terminal having a first surface defining a plurality of ridges protruding from the first surface, wherein a first ridge in the plurality of ridges has a first height above the first surface and is configured to provide a first electrical contact point between the terminal and a corresponding mating terminal, wherein a second ridge in the plurality of ridges has a second height above the first surface that is lower than the first height, wherein the second ridge in the plurality of ridges is configured to provide a second electrical contact point between the terminal and the corresponding mating terminal after the first electrical contact point is degraded by fretting, wherein the first surface defines a slit extending longitudinally along a length of the first surface, wherein the slit has a width of less than 0.1 mm when the terminal is inserted within the corresponding mating terminal, and wherein the first surface is configured to exert a spring force against an inner surface of the corresponding mating terminal.

10. A method of manufacturing an electrical connector assembly, comprising the steps of:

providing a terminal preform formed of sheet metal, said terminal preform having a first surface;

forming a plurality of ridges in the first surface which protrude from the first surface, wherein a first ridge in the plurality of ridges has a first height above the first surface and a second ridge in the plurality of ridges has a second height above the first surface that is lower than the first height;

forming a plurality of indentations in the first surface that are recessed below the first surface;

arranging the plurality of ridges on perimeters of the plurality of indentations, wherein the plurality of ridges is formed by material of the terminal preform displaced from the plurality of indentations by a knurling process;

providing a first electrical contact point between the terminal and a corresponding mating terminal via the first ridge in the plurality of ridges; and providing a second electrical contact point between the terminal and a corresponding mating terminal via the second ridge in the plurality of ridges after the first electrical contact point is degraded by fretting.

11. The method according to claim 10, wherein the plurality of ridges and the plurality of indentations are simultaneously formed by the knurling process.

12. The method according to claim 10, further comprising the step of:

arranging the plurality of ridges between the first surface and the plurality of indentations.

13. The method according to claim 10, further comprising the step of:

bending the terminal preform such that the first surface has a generally cylindrical shape.

14. The method according to claim 13, further comprising the step of:

bending the terminal preform such that edges of the first surface define a slit extending longitudinally along a length of the first surface.

15. The method according to claim 10, wherein the second ridge in the plurality of ridges is configured to provide the second electrical contact point between the terminal and the corresponding mating terminal only after the first electrical contact point between the provided by the first ridge in the plurality of ridges terminal is degraded by fretting.

* * * * *